United States Patent [19]

Deppner

[11] Patent Number: 4,834,317

[45] Date of Patent: May 30, 1989

[54] SALVAGING DRONE EQUIPMENT

[75] Inventor: Horst Deppner, Langenargen, Fed. Rep. of Germany

[73] Assignee: Dornier GmbH, Friedrichshafen, Fed. Rep. of Germany

[21] Appl. No.: 27,604

[22] Filed: Mar. 18, 1987

[30] Foreign Application Priority Data

Mar. 19, 1986 [DE] Fed. Rep. of Germany ..... 3609199

[51] Int. Cl.[4] ..... B64D 3/00

[52] U.S. Cl. ..... 244/1 TD; 244/138 R; 244/147; 273/360

[58] Field of Search ..... 244/1 TD, 138 R, 139, 244/140, 1 R, 147, 3; 273/360, 361

[56] References Cited

U.S. PATENT DOCUMENTS

| | | | |
|---|---|---|---|
| 3,140,847 | 7/1964 | Ames, Jr. | 244/138 R |
| 3,273,835 | 9/1966 | Holt et al. | 244/138 R |
| 3,367,233 | 2/1968 | Silvershotz | 244/137.4 |
| 3,451,642 | 6/1969 | Wieland et al. | 244/139 |

FOREIGN PATENT DOCUMENTS 2511984 5/1976 Fed. Rep. of Germany .

*Primary Examiner*—Galen Barefoot
*Attorney, Agent, or Firm*—Ralf H. Siegemund

[57] ABSTRACT

Apparatus for salvaging a hit indicating sensor, mounted on a towed drone serving as target simulator and being fastened by means of a cable to a towing craft; the hit indicator is severed from the drone and parachuted to ground either on cable release or by external command.

6 Claims, 4 Drawing Sheets

FIG. 3a
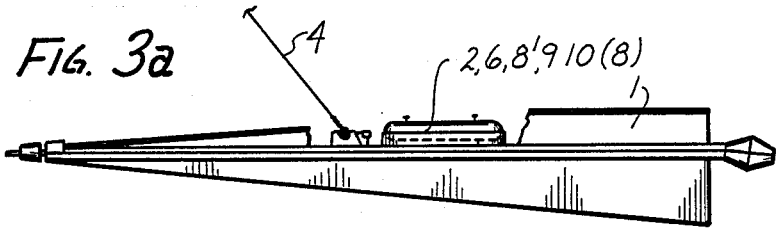
FIG. 3b
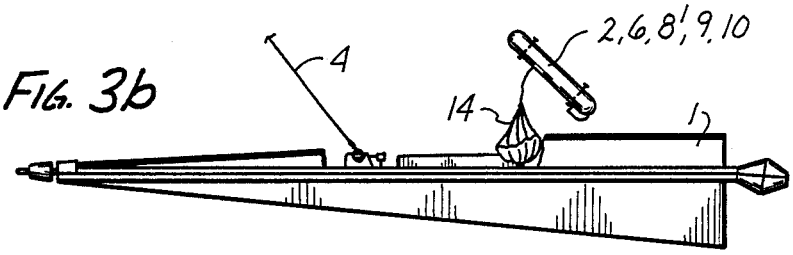
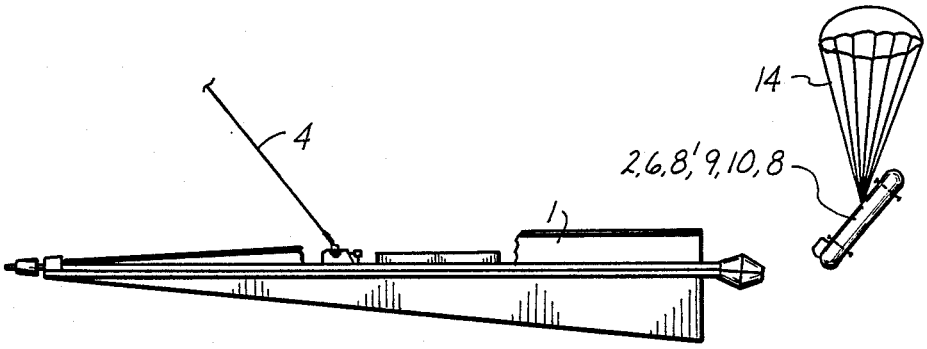
FIG. 3c

SALVAGING DRONE EQUIPMENT

BACKGROUND OF THE INVENTION

The present invention relates to the recovery and salvaging operation for dummy targets such as a dragged or towed drone which simulates a real target for target practice, the drone being normally fastened to a towing aircraft during the exercise.

Dummy targets of the type to which the invention pertains are generally used by the air forces of various countries. These dummy targets are used during exercises, for example, training exercises of air to air shooting using various kinds of weapons. These dummy targets are drones, being towed and dragged behind, for example, a regular aircraft. Such a target simulating drone is comprised, for example of a center spar to which are connected air foils of various sizes and which carry also a hit indicator. The equipment, i.e. the hit indicating sensor, as well as the drone itself, is usually regarded to be a one or single use object, i.e. once it has been used it is regarded as disposble. Generally speaking, this means that the drone following a mission, is separated from the towing aircraft, and it is not salvaged or recovered, unless it is provided with a parachute to permit recovery after landing.

German Pat. No. 25 11 984 discloses, for example, a recovery system for towed target simulating drones, which revovery system includes a parachute, triggered whenever the tension in the towing cable drops. Herein then, one provides the end of a towing cable as it is fastened to the drone, as an electrically conductive device, which serves as an electrical contact cooperating with an electrical contact ring on the drone body but being electrically insulated in relation to the skin of that drone. Upon contact making engagement, a control circuit activates parachute deployment. Particularly as the towing cable drops, the metallic cable engages this contact ring, and closes the circuit that includes that contact ring, and the connection to the control circuit is used as a trigger signal for ejecting and deploying the parachute.

It can readily be seen that this device and arrangement poses the following paradoxical problems. It is clear that one wants to recover as much equipment as possible. On the other hand, a successful mission will lead, at least, to severe damage, possibly, the distruction of the drone. Even if the parachute system is not damaged, or only to a minor extent, it may still not be worthwhile to recover what is left of the drone. On the other hand, the sensor device if, in fact, successfully signaled a hit, may well be recoverable, even though the drone itself is no longer worth salvaging. In this case then, it is either not recoverable because the parachute system was destroyed or one will recover the entire drone with sensor, including whatever is left of the drone, if it just so happened that the parachute system was not destroyed.

DESCRIPTION OF THE INVENTION

It is an object of the present invention to provide a new and improved device, by means of which the relatively light, small, but, by comparison, quite expensive hit sensor, including associated electronics, is separable from the drone, particularly in these cases in which the drone has been severely damaged, and to provide for recovery and salvage facilities of that sensor by and in itself.

In accordance with the preferred embodiment of the present invention, it is suggested to provide a recovery system which includes an electronic circuit which, together with the hit sensor, constitutes a unit that is connected with a parachute and is separated from the drone. Specifically, the salvaging system with the hit indicating sensor will be separated on the basis of telecommunicative activation. Alterntively, a particularly configured contact making and braking circuit will cause triggering of the salvaging system. Both modes of separation should be provided for normally. The activation and separation is preferably done through pyrotechnology.

The invention has the advantage that the hit indicating sensor is separable by mechanically triggering as well as by remote control, activating in either case the separation of the hit sensor with electronics and parachute from the body of the dummy target and drone. This way, it is possible with relative ease to land and permit recovery of the relatively light, but expensive, sensor and adjunct equipment, so that this particular recovered assembly can, in fact, be re-used. It was found that the cost savings are significant. The invention is based on the notion that the parachute for salvaging the hit sensor and associated electronics, is much smaller and less likely to be hit during the exercises. Rather than trying to salvage the entire drone with dubious chances of success, the effort is concentrated on what is most likely to be recoverable and happens to be most worthwhile.

Utilization of pyro-technology is of advantage. Following, e.g. the release of the towing cable, it will immediately drop owing to a relatively large aerodymanic resistance it has on release and as compared with the aerodynamic resistance of the towed dummy target. This cable will be retarded more than the drone underneath and will abut the upperside of that dummy target. Here, one should provide a contact making circuit e.g. in form of a micro switch or otherwise. For example a contact bar could be arranged on the dummy target and drone serves and cooperates with a contact on the cable. The resulting activation of the salvage electronic causes the production of an ignition pulse for pyro-technical separating elements severing electronics plus hit sensor and parachute at predetermined fracture points from the drone. Following this severing, the air resistance causes separation and the thus salvaged unit, including particularly the hit indicating sensor, will separate from the drone. The parachute system will now be pulled out of the body of the drone, released, and can now be deployed. The equipment is then suspended by and from the parachute, and will drop to ground at a predetermined or predeterminable rate of descent. Following recovery the sensor and the electronics can usually be re-used after more or less minor preparation.

It is advisable to provide a certain redundancy in that the salvage and separation process of the electronics and the sensor does not require the afore-described automatic activation, and, i.e. it should not rely exclusively on release of the towing cable. For this reason, an additional electronic circuit is included. That circuit responds to external commands. This case may arise, for example, if the craft has to turn and pull the drone and dummy target from an area from which recovery is possible at relative ease to a region where the drone may safely crash (ocean, desert), after the tail sensor has been jettisoned. Here then a certain command signal is desired to trigger the pyro-technical separating elements, independently from any tension or lack of it in the towing cable. If the recovery system has its own power supply, such as a battery, it will, in fact, operate completely autonomous.

DESCRIPTION OF THE DRAWINGS

While the specification concludes with claims particularly pointing out and distinctly claiming the subject matter which is regarded as the invention, it is believed that the invention, the objects and features of the invention, and further objects, features, and advantages thereof will be better understood from the following description taken in connection with the accompanying drawings in which:

FIGS. 3*a, b,* and *c* are analogous side views, but illustrating the sequence of salvage operation following a specific command.

Proceeding now to the detailed description of the drawings, FIG. 1 illustrates a dummy target configured as an aerodymanic body, constituting a towed or dragged drone. The salvaging system 2 is mounted on top of that drone and here, particularly, on a central spar 1'. Reference numeral 3 refers to the connection of a towing cable 4 which is fastened otherwise to an aircraft which is in front of and above the target drone. This connection 3 of the towing cable is positioned somewhat in front of the salvaging equipment 2. The salvaging system 2 is disposed within a housing 5, and a hit indicating sensor 6 is disposed on top of the housing 5. The housing 5 of the salvage system 2, including the salvage system that is contained in the housing, and the hit sensor mounted on top of the housing, constitute a unit. Together they are fastened to the drone body 1 by means of pyro-technically activatable, severing or separating elements 7. These may be situated, for example, as fracture points, being provided with detonating screws or rivets.

Figure 1A:
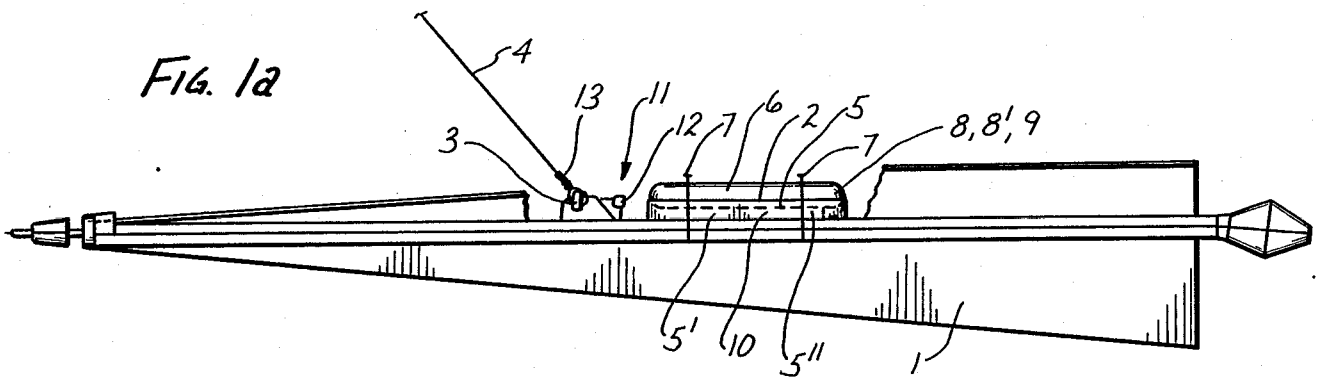
FIGS. 1*a* and 1*b* are, respectively, side and top elevations of a target simulating drone, constituting a dummy target, and including a recovery system in accordance with the preferred embodiment of the present invention for practicing the best mode thereof.

The salvaging system 2 includes a salvaging trigger electronics 8, and a command signal receiving electrics 8'. Dircuit 8' may include, generally, or is connected to an antenna (15-FIG. 4), and 8' includes further a receiver with decoder. Furthermore, a power supply 9 such as a battery is also included in that unit or salvage package. In addition, there is included a parachute system 10, a contact making and breaking circuit 11 which includes a stationary feeler 12 in the form of a short contact for engagement or disengagement with contacts 13 on the lower cable portion. The parachute system 10 is most specifically provided more in the front part 5' of the housing 5, front as seen in the direction of flight and towing, while the electronics, the power supply, and so forth, are stored in the rear part 5'' of housing 5. The hit sensor 6 is secured on top of these devices 8, 8', and 9. The outer contour of the housing 5 is matched to the configuration of the hit sensor 6, so that they together establish a uniform structure from the point of view of outer surface contour.

The feeler 12, being a transducer, is arranged close to the anchoring or connecting point 3 of the dragging or towing cable 4. This feeler determines the position generally of the cable 4 in relation to the body 1. In order to guarantee reliable operation of the mechanical activation by means of the sensor 12, a contact bar 13 is provided right on the cable 4. Upon release of the cable 4 by and from the towing aircraft, the drag on that cable 4 will, so to speak, push it back, so that the contact bar 13 pivots over and will engage the contact 12, thus activating circuit 12. This way, salvage operation is triggered. The feeler may be a micro switch or the like, orjust an electrical connection to bar 12 as shown.

Figure 1B:
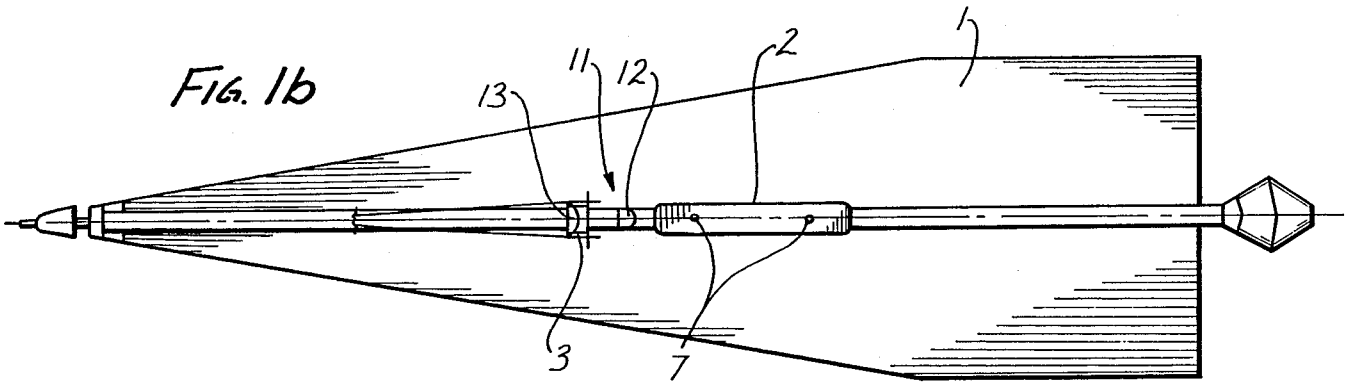
Figure 2A:
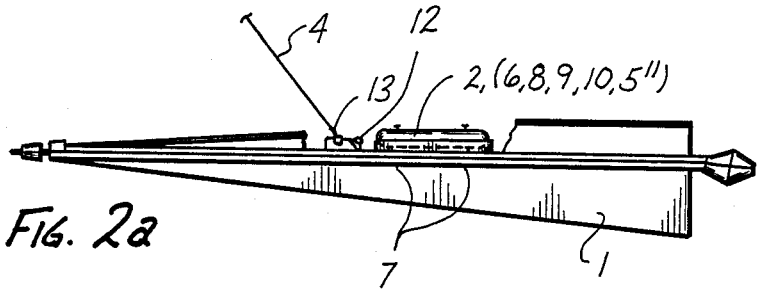
FIGS. 2*a, b, c,* and *d* are views similar to FIG. 1*a,* but demonstrating the sequence of salvage operations, using automatic triggering procedures on cable release.
Figure 2B:
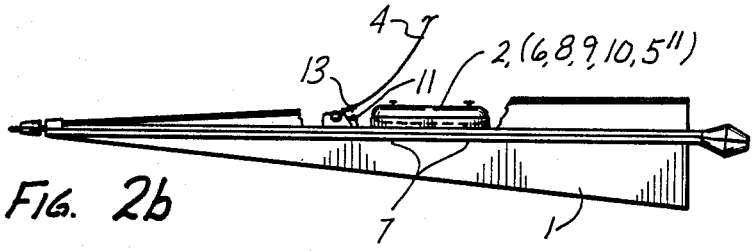

Turning now to FIGS. 2*a* through 2*d,* the figures show basically the elements 2, 6, 8, and 9 of FIGS. 1*a* and 1*b,* and the various figures indicate the sequence of salvaging. FIG. 2*a* basically shows the drone or dummy target body 1 in the dragging and towing situation, which corresponds basically to the illustration of FIG. 1*a.* It it assumed now (FIG. 2*b*) that the aircraft releases the cable 4, and the cable is, so to speak, pushed back, or one can say, that the aerodynamics, together with inertia, causes the drone 1 to continue its flight, at least for a short time, while the drag on the cable 4 pushes the cable back. Soon then, the situation will occur that the contact bar 13 engages the feeler 12.

Figure 2C:
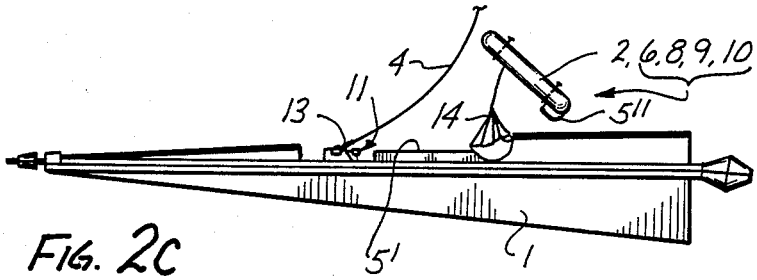

As shown in FIG. 2*c,* the pyro-technical elements 7 have been triggered by the contact making of circuit 11 (12 and 13), thereby releasing the housing 2, particularly the upper part of the housing that is configured as the sensor 6, and the portions contained in the rear part 5'' of the housing 5, namely the equipment 8, 8', 9. This way then, the parachute 14 is released. The pull-out of the parachute from the housing part 5' is also shown in FIG. 2*c,* and the ejection, so to speak, of the elements 2, 6, 8, 9, and 10, as a unit, is likewise visible in that figure.

Figure 2D:
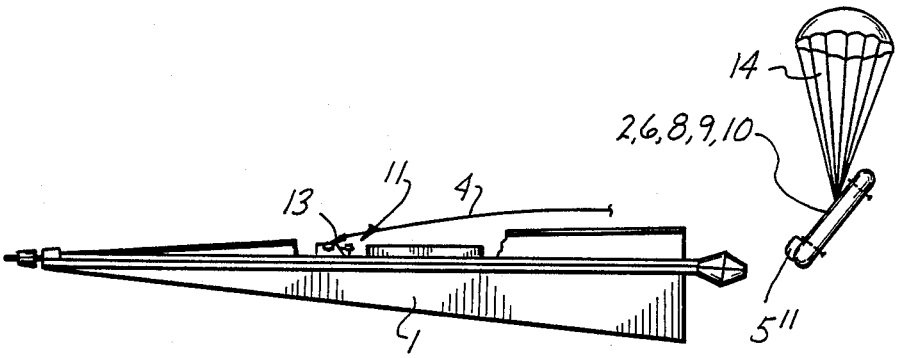

As shown in FIG. 2*d,* soon the parachute 14 will be fully deployed, and the unit 2' as suspended by the parachute, or more or less gradually drops to ground, and permits salvage and recovery. The drone 1 is doomed for oblivion. The sequence, as depicted in FIGS. 2*a* through 2*d,* is fully automatic, and its ultimate or primary triggering is the release by the cable 4 from the towing aircraft.

FIG. 3*a, b,* and *c* illustrate the salvage operation, but in dependence upon a command. In this case, it is assumed that the drone body 1 continues to be towed by the aircraft. The pyro-technical separating or severing elements 7 are triggered here, following a receipt of a command either from the towing aircraft, from another aircraft, or from ground. The command is received by the electronic circuit 8', preferably decoded in order to avoid unwanted spurious triggering, whereupon the element 7 are ignited.

FIG. 3*b* is quite analogous to FIG. 2*c,* except that the cable 4 continues to be towed. The same is true, as far as FIGS. 3*c* and 2*d* are concerned. In other words, following the triggering of the separating elements 7, further operation is the same in both instances, the only difference is the relative position of cable 4.

Figure 4:
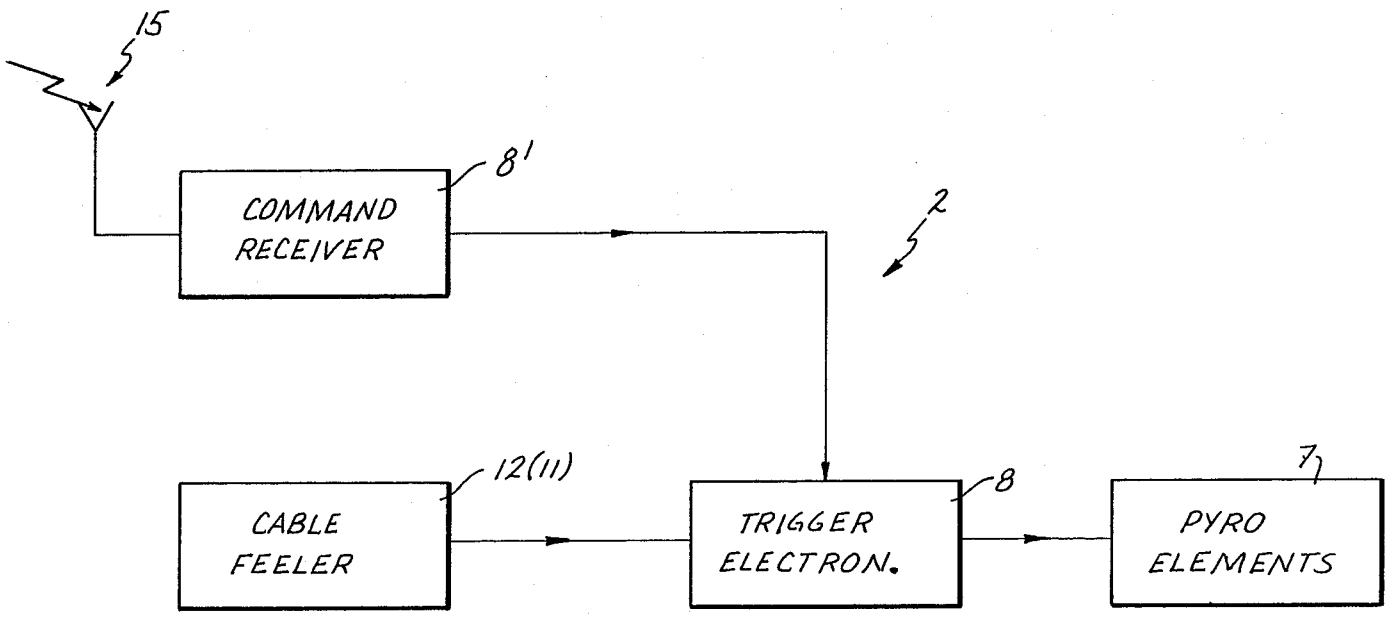
FIG. 4 is a block diagram showing the requisite circuit for obtaining either the operation as per FIG. 2, or the operation as per FIG. 3.

FIG. 4 illustrates in principle a block diagram that is involved in the operation for deploying the parachute and separating the sensor with electronics from the drone 1. There is then, on one hand, the receiver electronics 8', connected to the antenna 15 through which a signal is received either from the aircraft or from ground or from another accompanying aircraft or the like, which signals are decoded and serve as an operating signal for the trigger electronics 8. Alternatively, a signal is issued to the electronics 8 from the cable position feeler 11. Either signal is used by the electronics 8 to fire the pyrotechnical elements 7.

Normally, one will use dual trigger arrangements, simply because it may not be foreseeable which type of salvage triggering will ultimately be used. However, in those cases in which it is clear ab initio that there will be release by cable release, then the system can be simplified and the receiving electronics 8', as well as the antenna 15, can be omitted. The circuit simply operates then on the basis as outlined above with reference to FIGS. 2*a* through 2d. Analogously, in case the release is most likely to occur prior to release of the drone, then the contact circuit 11, contacts 12, and 13, are superfluous and release may then be exclusively tight to the receiving of an external command. This situation may arise, for example, if it is more reasonable to trigger parachute deployment over land, for example, in an easily accessible area following which the craft may tow the damaged drone out above the ocean before releasing the cable 4.

The invention is not limited to the embodiments described above, but all changes and modifications thereof, not constituting departures from the spirit and scope of the invention, are intended to be included.

I claim:

1. Apparatus for salvaging a hit indicating sensor, mounted on a towed drone carrying a parachute and serving as target simulator, there being a fastening arrangement for a cable by means of which the vehicle is towed, the cable being releasably fastened to the towing craft comprising:

an electronic circuit including the hit sensor and being physically connected to the parachute and being further connected, as a unit, to the drone by means of severable elements;

operating means connected to the electronic circuit and to be responsive to a signal for providing a trigger signal to initiate separation of said unit from the craft through rupture of the severable elements; and cable position sensing means, operating in response to a change in position of the cable on account of release from the towing craft to provide said signal that provides the trigger signal to be used by the operating means for separating the unit from the drone.

2. Apparatus as in claim 1, including a transducer connected to the cable at said fastening arrangement and cooperating with a stationary element on the drone such that normally these elements are separated but engage for contact making on release of the cable, to thereby provide said triggering and control signal.

3. Apparatus as in claim 1, wherein said severable elements are pyro-technically effective severing elements.

4. Apparatus as in claim 1, and including a local source for power supply.

5. Apparatus as in claim 1 and including, in addition, receiver means responsive to an externally provided command to provide a control signal for triggering separation of the unit from the drone.

6. Apparatus as in claim 5, wherein said severable elements are pyro-technically effective severing elements.

* * * * *